US010138099B2

(12) United States Patent
Huang

(10) Patent No.: US 10,138,099 B2
(45) Date of Patent: Nov. 27, 2018

(54) POWER WINCH HORIZONTAL-PUSH WINCH

(71) Applicant: Comeup Industries Inc., Taipei (TW)

(72) Inventor: Shih Jyi Huang, Taipei (TW)

(73) Assignee: Comeup Industries Inc., Taipei (TW)

( * ) Notice: Subject to any disclaimer, the term of this patent is extended or adjusted under 35 U.S.C. 154(b) by 92 days.

(21) Appl. No.: 15/464,497

(22) Filed: Mar. 21, 2017

(65) Prior Publication Data

US 2018/0273357 A1 Sep. 27, 2018

(51) Int. Cl.

*B66D 1/42* (2006.01)
*B66D 1/12* (2006.01)
*B66D 1/24* (2006.01)

(52) U.S. Cl.

CPC ..... *B66D 1/42* (2013.01); *B66D 1/12* (2013.01); *B66D 1/24* (2013.01); *B66D 2700/0183* (2013.01)

(58) Field of Classification Search

CPC ... B66D 1/42; B66D 1/12; B66D 1/24; B66D 1/22; B66D 1/00; B66D 2700/0183
See application file for complete search history.

(56) References Cited

U.S. PATENT DOCUMENTS 5,842,684 A * 12/1998 Aho ..... B66D 1/08 254/344
7,568,559 B2 * 8/2009 Huang ..... B66D 5/06 188/72.7
7,648,125 B1 1/2010 Huang
8,973,902 B2 * 3/2015 Huang ..... F16D 11/16 254/355
9,902,597 B2 * 2/2018 Huang ..... B66D 1/12
9,908,752 B2 * 3/2018 Huang ..... B66D 1/12
2008/0000735 A1 * 1/2008 Huang ..... B60T 13/02 188/171
2008/0001132 A1 * 1/2008 Huang ..... B66D 1/12 254/362
2010/0155190 A1 * 6/2010 Xie ..... B66D 1/14 192/71
2014/0174879 A1 * 6/2014 Huang ..... F16D 11/16 192/71
2018/0118533 A1 * 5/2018 Karambelas ..... B66D 1/48
(Continued)

FOREIGN PATENT DOCUMENTS

CN 2466129 Y 12/2001
CN 2868972 Y 2/2007
CN 201254436 Y 6/2009
(Continued)

*Primary Examiner* — Michael E Gallion
(74) *Attorney, Agent, or Firm* — Alan D. Kamrath; Kamrath IP Lawfirm, P.A.

(57) ABSTRACT

A power winch horizontal-push winch, and that the power winch includes a clutch, and an operating handle is turned to move transversely to push a clutch lever through a binding groove to apply or not to apply a force to an insert slot to transmit or not to transmit the power to the cable wheel. The operating handle can change the installation angle or remove/replace the operating handle anytime. The operating handle has a penetrating hole near an outer side for receiving an end hook of a rod-shaped object, and the operating handle may be linked to turn transversely by applying a force to the rod-shaped object.

5 Claims, 7 Drawing Sheets

(56) References Cited

U.S. PATENT DOCUMENTS

2018/0201486 A1* 7/2018 Huang ..... B66D 1/02

FOREIGN PATENT DOCUMENTS

| | | |
|---|---|---|
| TW | 188404 | 8/1992 |
| TW | 477358 U | 2/2002 |
| TW | M291421 U | 6/2006 |
| TW | M344336 U | 11/2008 |

* cited by examiner

POWER WINCH HORIZONTAL-PUSH WINCH

BACKGROUND OF THE INVENTION

Field of the Invention

The present invention relates to a power winch horizontal-push winch, and more particularly to the clutch of a power winch having an operating handle for adjusting or changing an installation angle or remove/replace a different operating handle anytime to make the job of changing the operating handle to a different installation angle and replacing the operating handle easy.

Description of the Related Art

In general, a power winch is designed for hanging or dragging a load. In a common example, a hoisting machine for hanging or lifting goods in high-rise buildings is a power winch. A cable winch installed to jeeps or off-road vehicles for towing another vehicle (rescuing others) or escaping from a dangerous situation (rescuing oneself) is also a power winch. In the operation principle of the power winch, a power source (such as a power motor) outputs a forward or reverse drive power to drive a cable wheel to rotate in a forward or reverse direction after the action of a deceleration mechanism, so as to release or rewind a cable, and a hammer hook is installed at the front end of the cable for hooking the load (such as a heavy object, or another vehicle or object) to move the load.

The power winch is designed to release or rewind the cable by power, so that the power winch is limited by the internal power of the power winch internal power for a decelerated transmission, and the speed of releasing or rewinding the cable will not be too fast. Usually, the conventional power winch fails to meet the speed requirement for releasing the cable by power in an emergency situation (such as the situation of rescuing a vehicle), and the operator will worry about the emergency situation. To overcome the aforementioned drawback, the conventional power winch generally includes a clutch capable of opening the power between the deceleration mechanism and a cable wheel when the clutch is set to a disengaged status, so that the rotation of the cable wheel will not be bound or restricted by the power to facilitate for labors to pull the cable quickly and directly (which is call a manual release of the cable) and allow rescuers to hook the vehicle to be rescued or a heavy object to be hoisted at an earlier time, and then the clutch is operated and set to its original engaged status, and then the power is transmitted to the cable again to close the power between the deceleration mechanism and the cable wheel through the deceleration mechanism, so as to achieve the effect of winding the cable to catch the heavy object by the power.

There are different assemblies and operating modes of the clutch of the conventional power winch including R.O.C. Pat. Nos. 477358, 188404, M291421, and M344336, P.R.C. Utility Model Nos. ZL01204721.X, ZL200520145068.5, and ZL200820128343.6 and U.S. Pat. No. 7,648,125 granted to the inventor of the present invention. In some of the aforementioned patents, an eccentric toggle is triggered to drive a linkage rod to move outward, so that a driving gear in the power winch is detached from the cable wheel to disconnect the power from the cable wheel to define a disengaged status. When the eccentric toggle is turned in a reverse direction to restore its original position, the power between the cable wheel is connected to define an engaged status. In some of the aforementioned patents, a clutch lever is pulled and lifted, so that a bottom end of the clutch lever is separated from the connection between the power and the cable wheel to define the disengaged status. On the other hand, the clutch lever is released, and the bottom end of the clutch lever enters into a brake opening, so that the power and the cable wheel are connected to define an engaged status. In some of the aforementioned patents, a knob installed on an opening side of a casing of the reducer is turned in a forward or reverse direction to drive a clutch slide installed in a clutch seat to move, to drive a shaft center to move synchronously and define a disengaged or disengaged status between an axial gear and an inner ring gear. Regardless of the aforementioned method of turning an eccentric toggle, pulling and lifting a clutch lever, or turning a knob, an obvious exposed gap is produced in the machine of the power winch, so that water (such as rainwater), dust, mud, or any other small foreign substance may enter into the machine from the gap, and damage the power winch or produce a malfunction.

In view of the drawbacks of the aforementioned patents, the inventor of the present invention further improves R.O.C. Utility Model No. M449152 entitled "Power winch horizontal-pull clutch device", P.R.C. Pat. No. ZL201220610649.1 entitled "Power winch horizontal-pull clutch" and U.S. Pat. No. 8,973,902 entitled "Power winch horizontal-pull clutch device by designing the power winch clutch as a sealed structure and setting the clutch lever in a horizontal-pull mode, so as to engage or disengage the clutch while the machine of the power winch does not produce an obvious gap, and thus the patented technology can prevent water, dust, or other foreign substances from entering the machine and reduce the probability of damaging the machine or producing a malfunction. However, the inventor of the present invention further improves the structure and assembly of the R.O.C. Utility Model No. M449152 (foreign counterparts P.R.C. Pat. No. ZL201220610649.1 and U.S. Pat. No. 8973902). Since the clutch of the aforementioned patents is designed as a sealed structure, therefore the operating handle of the clutch is combined and fixed securely, and both installation and removal involves more peripheral components, and the operating handle cannot be changed or replaced anytime easily according to actual needs or functions.

SUMMARY OF THE INVENTION

Therefore, it is a primary objective of the present invention to provide a power winch horizontal-push winch capable of easily adjusting or changing the installation angle of an operating handle anytime according to actual requirements and functions.

Another objective of the present invention is to provide a power winch horizontal-push winch capable of easily replacing the operating handle anytime according to actual requirements and functions.

To achieve the aforementioned and other objectives, the present invention provides a power winch horizontal-push winch, power winch, characterized in that the power winch supplies power from a power source and transmits the power to a cable wheel after a deceleration is made by a reducer, so that the cable wheel may be rotated in a forward or reverse direction to release or wind a cable wound around the cable wheel; a casing of the reducer has a binding groove formed thereon and an inner thread formed on an inner wall of the casing; the reducer includes an outer ring body having an insert hole formed on an outer surface of the reducer; the power winch includes a clutch, and positioning of a binding groove formed on the casing of the reducer may or may not be applied to the insert slot of the outer ring body, so that the power may or may not be transmitted from the reducer to the cable wheel; the clutch comprises an inner seat, a control plate, a wedge, an operating handle and a clutch lever, wherein the inner seat includes a cylindrical lower insert tube, a cylindrical upper insert tube, and a baffle with the middle in an outwardly extended angular form, and an outer wall of the lower insert tube has an outer thread, and the junction of the lower insert tube and the baffle has an O-ring, and the bottom end of the inner seat has an opening and a chamber formed deeply inside the opening, and the top end of the upper insert tube is passed to the outside to form an angular slot, and an upper sink socket is formed around the angular slot, and an upper ring groove and a lower ring groove are concavely formed on the outer surface of the inner seat, and the upper ring groove is provided for installing an O-ring; the control plate is in form of a round plate having a round bump at the bottom of the round plate, a circular penetrating hole penetrating through the middle of the round plate, and a plurality of corresponding elevating ribs is formed on the top side of the round plate and disposed on both sides of the penetrating hole; the wedge has a disc-shaped base, an angular slot penetrating the middle of the wedge, and a plurality of adjusting members in an arc shape and disposed at the bottom of the base, and the bottom surface of each adjusting member is divided into an oblique slope and a press-in slot, and the oblique slope descends gradually from the bottom surface of the base and passes through a boundary edge to enter into the press-in slot after reaching the bottom, and a spacing is formed between two adjusting members, and the spacing disposed at the edge of the base is the narrowest, so as to form a through hole, and the through hole has a width not smaller than the width of the elevating rib; the operating handle comprises a socket portion and a handle portion, and the bottom surface of the socket portion is inwardly hollow, and the hollow top forms a first accommodation space sufficient to accommodate the wedge, and the hollow middle section has a plurality of even accommodating slots, each accommodating slot is configured to be corresponsive to the center and arranged in a surrounding form, and the accommodating slot has a width sufficient to accommodate the elevating rib, and a hollow bottom of the accommodating slot is a second accommodation space, and the second accommodation space has a size sufficient to accommodate the control plate and the upper insert tube of the inner seat, and a plurality of screw holes are formed on a side wall proximate to the bottom for screwing and installing a positioning bolt; the handle portion is extended laterally from the socket portion to the outside to form a handle object provided for being held by a user's hand; the clutch lever has an insert member which can be accommodated in the chamber of the inner seat, and selectively controlled to pass downwardly out from the opening of the inner seat and insert into the insert slot of the outer ring body; the insert member has a polygonal prism coupled thereto, and the polygonal prism of the insert member has a shape matched with an angular slot of the inner seat and an angular slot of the wedge, and an outer surface of the polygonal prism of the insert member has a ring groove formed at a position proximate to the top, and the polygonal prism of the insert member is provided for sheathing and installing an elastic member, and the ring groove is provided for clamping and positioning a latch ring; during assembling, the elastic member of the clutch lever is sheathed and mounted on the polygonal prism, and the polygonal prism is passed from bottom to top and out from the angular slot of the inner seat, such that the insert member of the clutch lever enters into the chamber of the inner seat; and then the control plate is installed next to the top side of the top side of the upper insert tube of the inner seat, and the round bump at the bottom of the control plate enters and stays in the upper sink socket at the top side of the upper insert tube, and the polygonal prism of the clutch lever is passed out from the penetrating hole of the control plate; and then the wedge is installed next to the top side of the control plate, such that the two through holes of the wedge are disposed across an elevating rib, and the polygonal prism of the clutch lever is passed from bottom to top and out from the angular slot of the wedge, and then the latch ring is clamped in the groove of the polygonal prism; and then the outer thread of the lower insert tube of the inner seat is screwed and engaged with the inner thread of the binding groove of the casing of the reducer to abut the O-ring at the junction of the lower insert tube and the baffle, while the periphery of the bottom of the baffle abuts the sink socket at the outer periphery of the top side of the binding groove for positioning; and then the socket portion of the operating handle is sheathed on the wedge and the clutch lever, and the wedge and the top end of the clutch lever enter into the first accommodation space of the socket portion, and the elevating rib of the control plate enter into the plurality of accommodating slots for positioning, and the plate body of the control plate and the socket of the inner seat enter into the second accommodation space, while the inner wall of the socket portion abuts the O-ring sheathed on the upper ring groove of the upper socket, and the screw hole of the socket portion is aligned precisely with the lower ring groove of the upper socket, and then the positioning bolt is screwed into each screw hole, so that the rear end of the positioning bolt passes out from the screw hole and enters into the lower ring groove.

In the aforementioned power winch horizontal-push winch, wherein the operating handle has a plurality of even accommodating slots grouped on the same straight line and provided for selecting an appropriate angular position suitable for accommodating the elevating rib.

In the aforementioned power winch horizontal-push winch, the screw holes of the operating handle are formed on the transversally symmetric walls of the socket portion.

In the aforementioned power winch horizontal-push winch, the operating handle has a penetrating hole formed at a position of the handle portion proximate to the outer side of the operating handle.

In the aforementioned power winch horizontal-push winch, the penetrating hole of the handle portion is provided for installing an end hold of a rod-shaped object, and a force may be applied to operate the rod-shaped object to link and turn the handle portion to deflect transversely.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
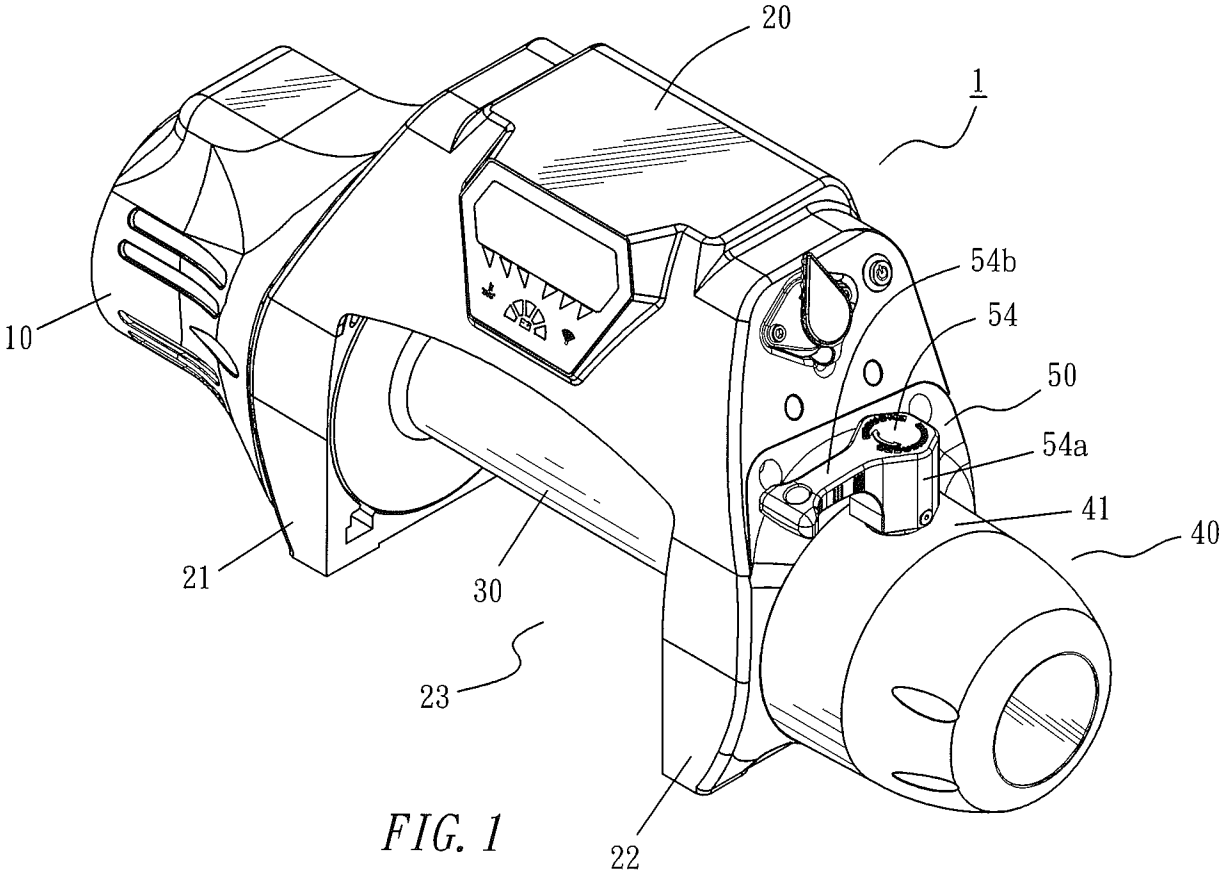
FIG. 1 is a perspective view of a preferred embodiment of the present invention situated at an engaged status.
Figure 2:
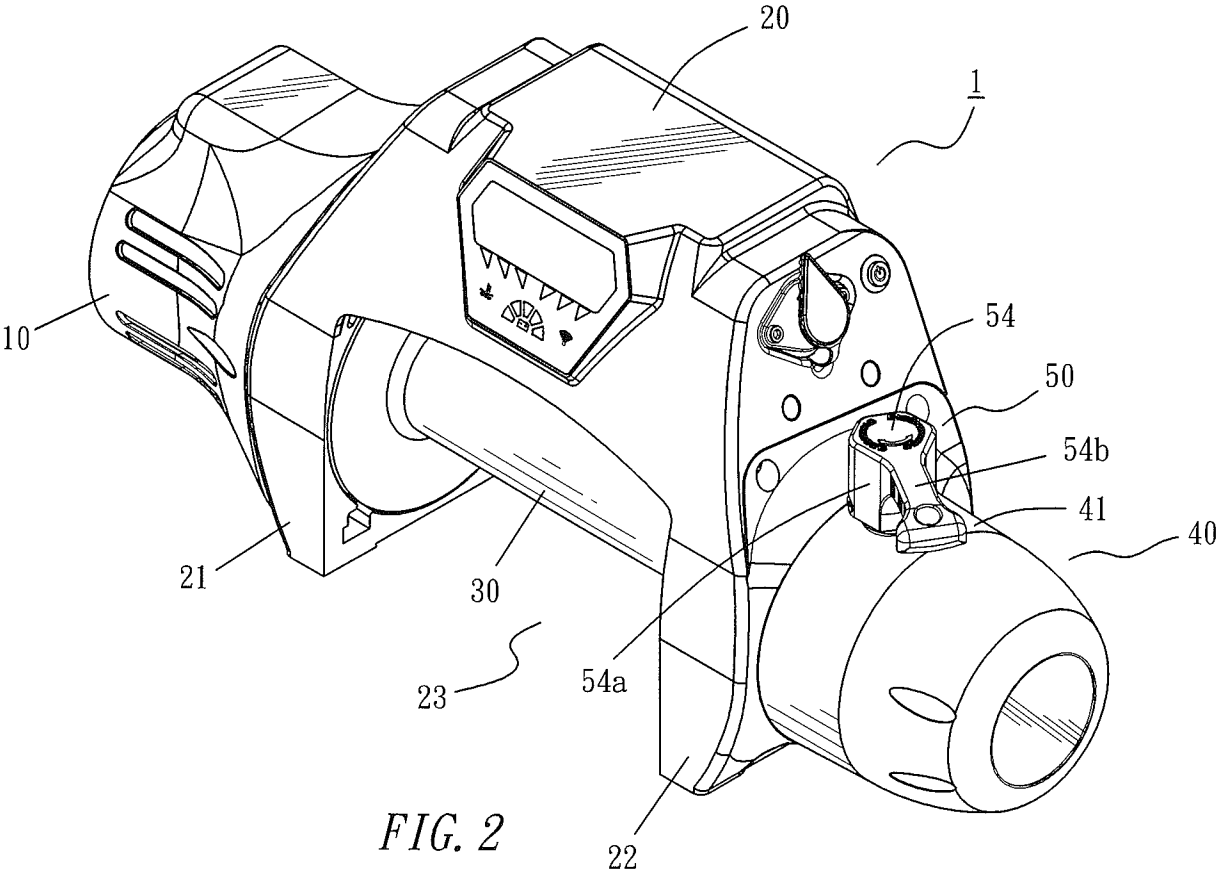
FIG. 2 is a perspective view of a preferred embodiment of the present invention situated at a disengaged status.

With reference to FIGS. 1 and 2 for a power winch 1 in accordance with a preferred embodiment of the present invention, the power winch 1 comprises: a power source 10 (such as a motor) disposed on a side of the power winch 1; a main frame body 20 disposed at the middle of the top of the power winch 1, and a group of support bases 21, 22 being extended downwardly from both sides of the power winch 1 and a space 23 being formed between the two support bases 21, 22, and a side of the power source 10 being coupled to the outer side of the support base 21; a cable wheel 30, installed in the space 23 between the support bases 21, 22, but not structurally or electrically coupled with the support bases 21, 22, for winding a cable (not shown in the figure), and the outermost end of the cable generally having a hammer hook (not shown in the figure) for hooking and hanging a heavy object; a reducer 40, installed to an outer side of the support base 22 and having a casing 41 coupled to the support base 22; and a clutch 50, partially installed in the casing 41 of the reducer 40 and extended upwardly, such that the clutch 50 only has an operating handle 54 exposed to the outside, and other components are hidden in the operating handle 54. The power of the power winch 1 is supplied from the power source 10 and transmitted by a shaft to the reducer 40, and decelerated by the reducer 40 for several levels before it is transmitted to the cable wheel 30, so that the cable wheel 30 can be driven to rotate in a forward or reverse direction; the clutch 50 transmits the power between the reducer 40 and the cable wheel 30 to maintain a Close or Open status.

Figure 3:
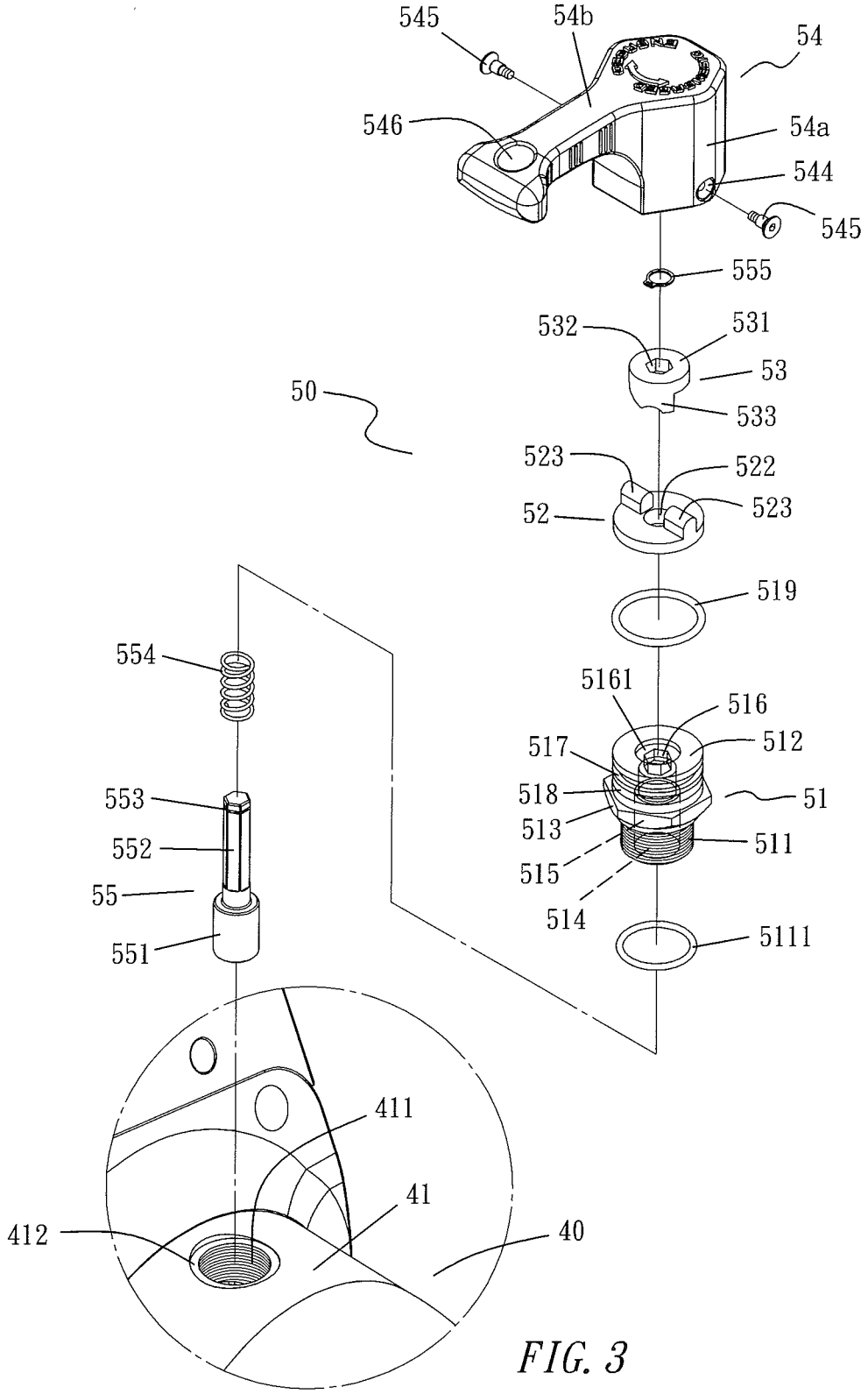
FIG. 3 is an exploded view of a clutch and a portion of a reducer of a preferred embodiment of the present invention.
Figure 4:
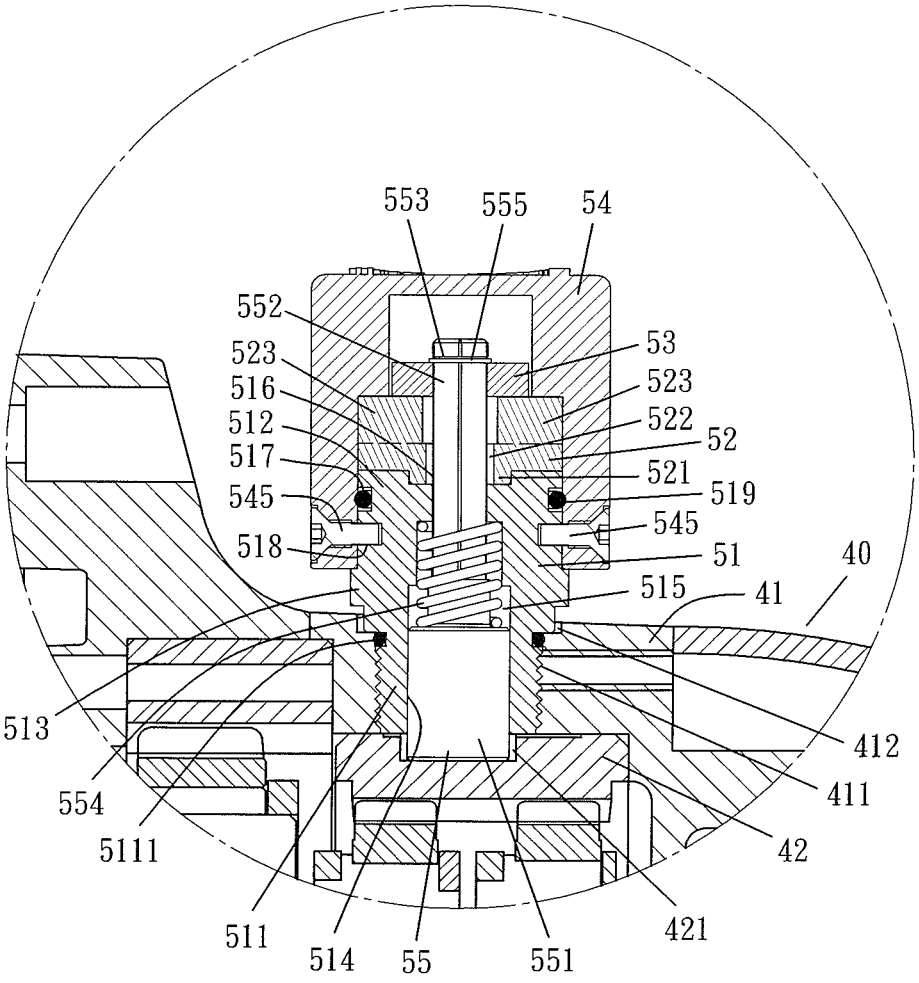
FIG. 4 is a partial sectional view of a preferred embodiment of the present invention situated at an engaged status.

With reference to FIGS. 3 and 4, the reducer 40 has an outer ring body 42 which is a component for transmitting power between the reducer 40 and the cable wheel 30. When the clutch 50 is operated and the outer ring body 42 is fixed, the power may be transmitted from the reducer 40 to the cable wheel 30. When the clutch 50 is operated and the outer ring body 42 is not fixed (but rotated), the power cannot be transmitted from the reducer 40 to the cable wheel 30, and the outer surface of the outer ring body 42 has an insert slot 421; the casing 41 of the reducer 40 has a binding groove 411 formed thereon (as shown in FIG. 3) and installed parallel to the insert slot 421, but the binding groove 411 has a diameter greater than the insert slot 421, and the inner wall of the binding groove 411 has an inner thread, and the external periphery of the top side of the binding groove forms a sink socket 412 with an increased external diameter.

In FIGS. 3 and 4, the clutch 50 comprises an inner seat 51, a control plate 52, a wedge 53, an operating handle 54 and a clutch lever 55, wherein the inner seat 51 includes a cylindrical lower insert tube 511, a cylindrical upper insert tube 512 and a baffle 513 in an extended angular shape and disposed at the middle, and the outer wall of the lower insert tube 511 has an outer thread screwed and coupled to the inner thread of the binding groove 411, and an O-ring 5111 is sheathed on the junction of the lower insert tube 511 and the baffle 513, so that the top edge of the outer thread and the bottom end of the inner seat 51 have an opening 514 and a chamber 515 is formed inwardly and deeply in the opening 514, and the top end of the upper insert tube 512 is passed out to form a non-circular (such as a polygonal) angular slot 516, and the periphery of the angular slot 516 forms an upper sink socket 5161, and the outer surface of the upper insert tube 512 of the inner seat 51 further has an upper ring groove 517 and a lower ring groove 518 formed thereon, wherein the upper ring groove 517 is provided for sheathing and installing an O-ring 519; the control plate 52 is in form of a round plate having a round bump 521 at the bottom, a circular penetrating hole 522 penetrating the middle, and a plurality of elevating ribs 523 formed at the top side and disposed symmetrically on both sides of the penetrating hole 522.

Figure 5:
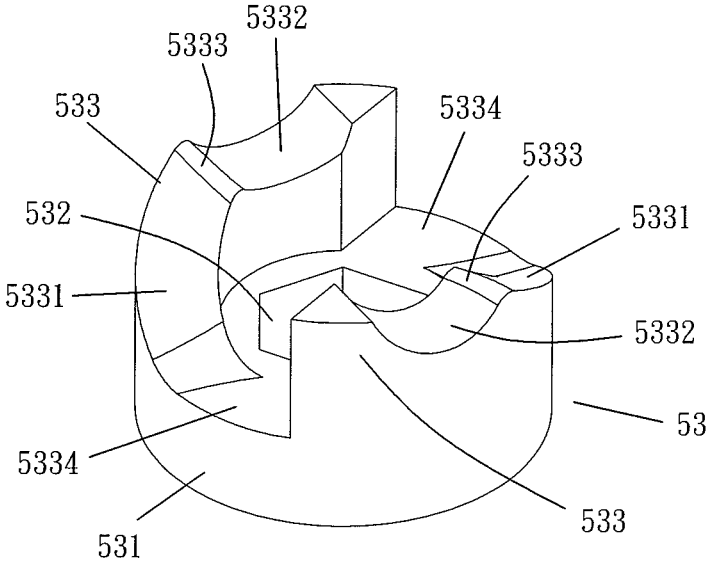
FIG. 5 is a bottom view of a wedge of a preferred embodiment of the present invention.

The wedge 53 has a disc-shaped base 531, a non-circular cylindrical (such as a hexagonal) angular slot 532 penetrating through the middle (refer to FIG. 5 for the statuses of turning the wedge 54 upside down), the base 531, and a plurality of adjusting members 533 in an arc shape and disposed on both sides symmetrically, and the bottom of each adjusting member 543 being divided into an oblique slope 5331 and a press-in slot 5332, and the oblique slope 5331 dropping from the bottom of the base 531 and entering into the press-in slot 5332 after reaching the bottom and passing through a boundary edge 5333, and a spacing being formed between two adjusting members 533, and the spacing disposed at the edge of the base 531 being the narrowest, so that each spacing forming a through hole 5334, and the through hole 5334 having a width not smaller than the width of the elevating rib 523.

Figure 6:
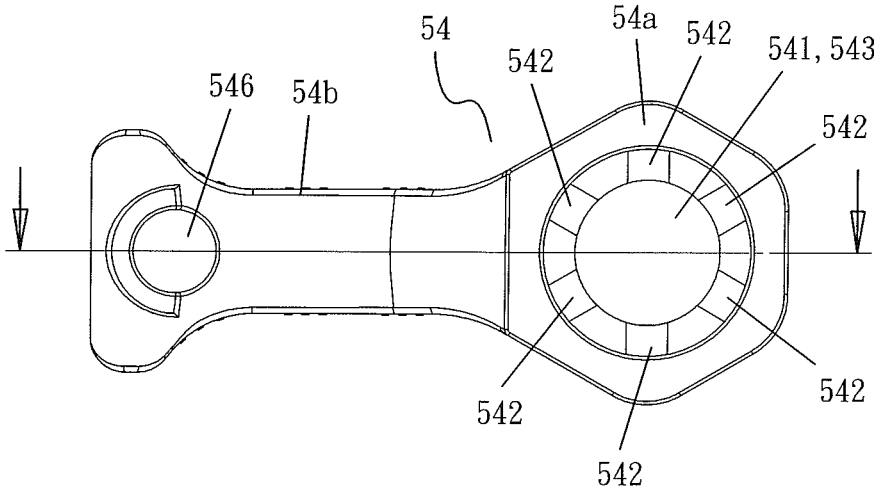
FIG. 6 is a bottom view of an operating handle of a preferred embodiment of the present invention.
Figure 7:
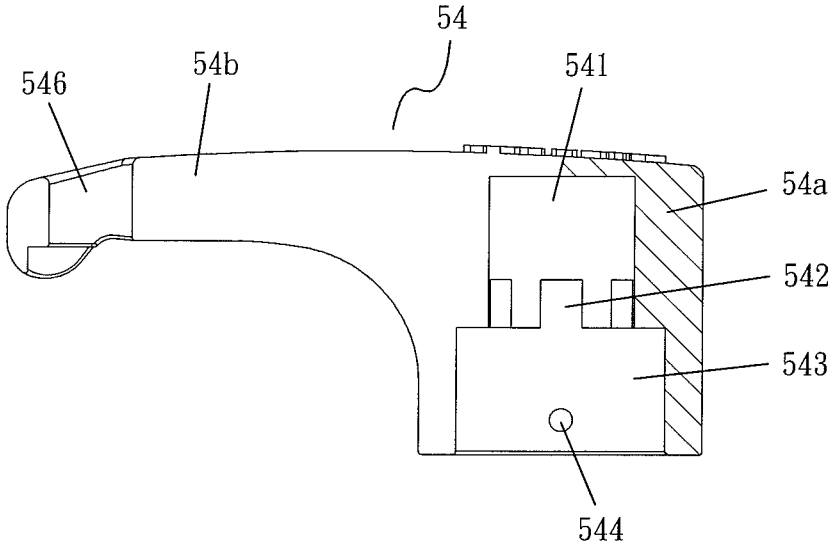
FIG. 7 is a longitudinal sectional view of an operating handle of a preferred embodiment of the present invention.

The operating handle 54 comprises a socket portion **54*a* and a handle portion 54*b*. With reference to FIGS. 6 and 7, the bottom of the socket portion 54*a* is inwardly hollow, and the hollow top forms a first accommodation space 541 sufficient to accommodate the wedge 53, and the hollow middle section has a plurality of even (such as six) accommodating slots 542, and all accommodating slots 542 are configured to be corresponsive to the center and arranged in a surrounding form, so that the accommodating slots 542 on the same straight line are grouped, and all (such as six) accommodating slots 542 are divided into groups divisible by two (such as three groups), and the accommodating slot 542 has a width precisely fitting the accommodation of the elevating rib 523, and the hollow bottom is a second accommodation space 543 sufficient to accommodate the control plate 52 and the upper insert tube 512 of the inner seat 51 altogether, and a side wall near the bottom has a plurality of screw holes 544 preferably formed on a horizontally symmetric wall, and the plurality of screw holes 544 are provided for screwing and installing positioning bolts 545, and the handle portion 54*b* is extended laterally from the socket portion 54*a* to the outside to form a handle object provided for a user to hold, and a penetrating hole 546 is formed at a position of the handle portion 54*b*** proximate to the outer side.

The clutch lever 55 has an insert member 551 that can be accommodated in the chamber 515 and selectively controlled to pass downwardly from the opening 514 to the outside, so as to selectively press into the insert slot 421 of the outer ring body 42. The insert member 551 has a non-circular cylindrical (such as a hexagonal) polygonal prism 552 thereon, and the non-circular cylindrical (hexagonal) angular slot 516 and angular slot 532 are matched with each other, and a ring groove 553 is formed on the outer surface of the polygonal prism 552 and proximate to the top, and the polygonal prism 552 is provided for installing an elastic member 554, and a latch ring 555 (such as a C-shaped latch ring) is clamped and fixed in the ring groove 553.

During assembling as shown in FIGS. 1 and 4, the elastic member 554 is passed and installed to the polygonal prism 552 of the clutch lever 55, and then the polygonal prism 552 is passed from bottom to top and out of the angular slot 516 of the inner seat 51, so that the polygonal prism 552 and the angular slot 516 are combined in the same shape (such as the same hexagonal shape). In the meantime, the insert member 551 of the clutch lever 55 enters and stays in the chamber 515 of the inner seat 51, and then the O-ring 519 is installed into the upper ring groove 517 of the inner seat 51, and then the control plate 52 is installed next to the top side of the upper insert tube 512 of the inner seat 51, so that the round bump 521 at the bottom of the control plate 52 enters and stays in the upper sink socket 5161 formed at the top side of the upper insert tube 512. Now, the penetrating hole 522 of the control plate 52 is aligned precisely with the angular slot 516 of the upper insert tube 512, so that the polygonal prism 552 of the clutch lever 55 is also passed out of the penetrating hole 522, and then the wedge 53 is installed next to the top side of the control plate 52, so that the two through holes 5334 of the wedge 53 are disposed across an elevating rib 523, and the polygonal prism 552 of the clutch lever 55 is passed from bottom to top and out of the angular slot 532 of the wedge 53, so that the polygonal prism 552 and the angular slot 532 are also combined in the same shape (such as a hexagonal shape), and then clamped into a groove 553 of the polygonal prism 552 by the latch ring 555, so that the inner seat 51, the control plate 52, the wedge 53 and the clutch lever 55 are assembled and combined into a structure, and then the inner seat 51 is screwed from the outer thread of the lower insert tube 511 into an inner thread of the binding groove 411 formed at the casing 41 of the reducer 40, so that the lower insert tube 511 and the binding groove 411 are combined closely with each other, and the O-ring 5111 is pressed tightly, and a sealed status between the inner seat 51 and the binding groove 411 is achieved. Now, the outer periphery of the bottom of the baffle 513 abuts the sink socket 412 at the top side of the binding groove 411 to achieve the positioning purpose. Now, the structure formed by the inner seat 51, the control plate 52, the wedge 53 and the clutch lever 55 is further combined with the casing 41 of the reducer 4.

The socket portion 54*a* of the operating handle 54 is passed from top to bottom and installed to the structure formed by the inner seat 51, the control plate 52, the wedge 53 and the clutch lever 55. During the process, the wedge 53 and the top of the clutch lever 55 enter and stay in the first accommodation space 541 of the socket portion 54*a*, and the elevating rib 523 of the control plate 52 enters and stays in a plurality of accommodating slots 542, and a plate body of the control plate 52 and the socket 512 of the inner seat 51 enter and stay in the second accommodation space 543. In the meantime, an inner wall of the socket portion 54*a* abuts the O-ring 519, so that a sealed status between the inner wall of the socket portion 54*a* and the upper socket 512 is achieved, and the screw hole 544 of the socket portion 54*a* will be aligned precisely with the lower ring groove 518 of the upper socket 512, so that the positioning bolt 545 is screwed into each screw hole 544, and the rear end of the positioning bolt 545 is passed out from the screw hole 544 to enter and stay in the lower ring groove 518, so as to complete the assembling of the clutch 50.

In the status as shown in FIGS. 1 and 4 the through hole 5334 of the wedge 53 abuts downwardly against the elevating rib 523 of the control plate 52. In other words, the wedge 53 is disposed at a relative low point position, so that a portion of the insert member 551 of the clutch lever 55 is passed out from the opening 514 of the lower insert tube 511 to enter and stay in the insert slot 421 of the outer ring body 42. The effect keeps the outer ring body 42 to remain unmoved (which is defined as an engaged effect), so that the power can be transmitted from reducer 40 to the cable wheel 30 to achieve the effects of releasing or rewinding a cable.

Figure 8:
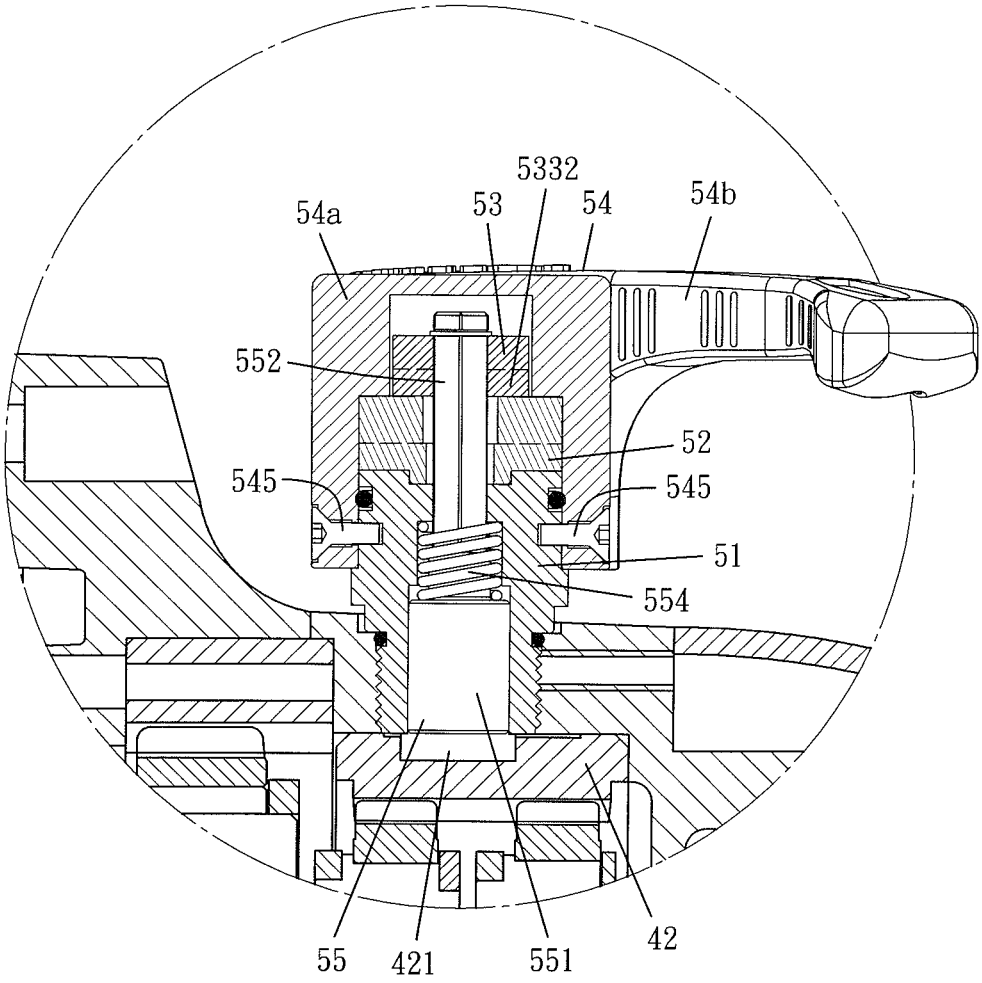
FIG. 8 is a partial sectional view of a preferred embodiment of the present invention situated at a disengaged status.

When a user wants to disconnect the power between the cable wheel 30 and the reducer 40 in order to manually release the cable in a quick and convenient manner, the user just needs to manually turn the handle portion 54*b* of the operating handle 54 to deflect transversely within a specific degree of curvature, so that the internal structure of the clutch 50 will change its status from the original one as shown in FIGS. 1 and 4 to the status as shown in FIGS. 2 and 8. When the handle portion 54*b* of the operating handle 54 are deflected transversely, the accommodating slot 542 will be linked with two elevating ribs 523 of the control plate 52 to rotate synchronously, so as to push an oblique slope 5331 of the wedge 53, so that the action of the component force drives the whole wedge 53 to rise gradually, and finally when the two elevating ribs 523 are rotated and moved across the boundary edge 5333, the two elevating ribs 523 enter and stay in the press-in slot 5332. Now, the socket portion 54*a* and the control plate 52 are turned together to a predetermined angle (approximately) 120°, and the wedge 53 is also lifted to a relative high point position (compared with FIG. 4). During the process, the clutch lever 55 is pushed by the lifting force of the wedge 53 to rise synchronously to compress the elastic member 554 due to the limitation by the latch ring 555. When the two elevating ribs 523 are rotated to enter and stay in the press-in slot 5332, the insert member 551 of the clutch lever 55 also rises to separate from the insert slot 421 of the outer ring body 42 (as shown in FIG. 8). Now, the outer ring body 42 is not fixed (which is defined as a disengaged effect) and can be rotated, so that the power of the reducer 40 cannot be transmitted to the cable wheel 30, and the user can manually release the cable quickly.

When the user wants to restore the cable from its release or rewind by power, the user just needs to manually turn the handle portion 54*b* of the operating handle 54 in a reverse direction to restore the status as shown in FIGS. 2 and 8 to the status as shown in FIGS. 1 and 4. The accommodating slot 542 is linked with the two elevating ribs 523 of the control plate 52 to rotate synchronously to restore the status of originally staying the press-in slot 5332 to the status of staying in the through hole 5334. Under the elastic effect of the elastic member 554, the wedge 53 and the clutch lever 55 descend together, so that the insert member 551 of the clutch lever 55 enters and stays in the insert slot 421 of the outer ring body 42, so that the outer ring body 42 is fixed again (to define an engaged effect), and the power is transmitted from the reducer 40 to the cable wheel 30 again, so as to achieve the effect of releasing or rewinding the cable by the power.

After the clutch 50 is assembled, the handle portion 54*b* of the operating handle 54 is preferably formed at a certain angular position in a longitudinal direction of the whole power winch 1 to facilitate the operation. In the structure of the present invention, the operating handle 54 is finally installed, and the positioning bolt 545 can be removed anytime to take away the operating handle 54, and then reinstalled anytime, and there are several groups of accommodating slots 542 (such as three groups) for selectively fitting the angular position to accommodate the elevating rib 523 of the control plate 52, so that the handle portion 54*b* of the operating handle 54 can adjust its installation angle anytime. When the whole power winch 1 is installed to a car (such as the front bumper of the car), an appropriate angle for extending the handle portion 54*b* can be selected according to the space of installation and the limitation of the operation, and then the operating handle 54 is reinstalled. Whenever the installation is found to be improper, the positioning bolt 545 may be removed anytime to take down the operating handle 54, and an appropriate angle is selected before installing the operating handle. Obviously, the application is very convenient.

The handle portion 54*b* of the operating handle 54 has the penetrating hole 546 formed at a position near the outer side to facilitate the operation of hooking the front end of a rod-shaped object with the penetrating hole 546 before the operator's turning movement, so that the other end of the rod-shaped object will be extended outside the car body (such as the front bumper), so that the user may apply a force to operate the rod-shaped object and link the handle portion to deflect horizontally. Such arrangement makes the operation of the operating handle 54 more convenient and easier.

In summation of the description, the improvements made by the present invention reside on that the operating handle may adjust its installation angle or remove/replace the operating handle anytime, so as to make the job of adjusting the operating handle to a different installation angle and replacing a different operating handle very easily.

The power winch horizontal-push winch in accordance with the present invention complies with patent application requirements, and is thus duly filed for patent application. While the invention has been described by means of specific embodiments, numerous modifications and variations could be made thereto by those skilled in the art without departing from the scope and spirit of the invention set forth in the claims.

What is claimed is:

1. A power winch horizontal-push winch, characterized in that the power winch supplies power from a power source and transmits the power to a cable wheel after a deceleration is made by a reducer, so that the cable wheel may be rotated in a forward or reverse direction to release or wind a cable wound around the cable wheel; a casing of the reducer has a binding groove formed thereon and an inner thread formed on an inner wall of the casing; the reducer includes an outer ring body having an insert hole formed on an outer surface of the reducer; the power winch includes a clutch, and positioning of a binding groove formed on the casing of the reducer may or may not be applied to the insert slot of the outer ring body, so that the power may or may not be transmitted from the reducer to the cable wheel; the clutch comprises an inner seat, a control plate, a wedge, an operating handle and a clutch lever, wherein the inner seat includes a cylindrical lower insert tube, a cylindrical upper insert tube, and a baffle with the middle in an outwardly extended angular form, and an outer wall of the lower insert tube has an outer thread, and the junction of the lower insert tube and the baffle has an O-ring, and the bottom end of the inner seat has an opening and a chamber formed deeply inside the opening, and the top end of the upper insert tube is passed to the outside to form an angular slot, and an upper sink socket is formed around the angular slot, and an upper ring groove and a lower ring groove are concavely formed on the outer surface of the inner seat, and the upper ring groove is provided for installing an O-ring; the control plate is in form of a round plate having a round bump at the bottom of the round plate, a circular penetrating hole penetrating through the middle of the round plate, and a plurality of corresponding elevating ribs is formed on the top side of the round plate and disposed on both sides of the penetrating hole; the wedge has a disc-shaped base, an angular slot penetrating the middle of the wedge, and a plurality of adjusting members in an arc shape and disposed at the bottom of the base, and the bottom surface of each adjusting member is divided into an oblique slope and a press-in slot, and the oblique slope descends gradually from the bottom surface of the base and passes through a boundary edge to enter into the press-in slot after reaching the bottom, and a spacing is formed between two adjusting members, and the spacing disposed at the edge of the base is the narrowest, so as to form a through hole, and the through hole has a width not smaller than the width of the elevating rib; the operating handle comprises a socket portion and a handle portion, and the bottom surface of the socket portion is inwardly hollow, and the hollow top forms a first accommodation space sufficient to accommodate the wedge, and the hollow middle section has a plurality of even accommodating slots, each accommodating slot is configured to be corresponsive to the center and arranged in a surrounding form, and the accommodating slot has a width sufficient to accommodate the elevating rib, and a hollow bottom of the accommodating slot is a second accommodation space, and the second accommodation space has a size sufficient to accommodate the control plate and the upper insert tube of the inner seat, and a plurality of screw holes are formed on a side wall proximate to the bottom for screwing and installing a positioning bolt; the handle portion is extended laterally from the socket portion to the outside to form a handle object provided for being held by a user's hand; the clutch lever has an insert member which can be accommodated in the chamber of the inner seat, and selectively controlled to pass downwardly out from the opening of the inner seat and insert into the insert slot of the outer ring body; the insert member has a polygonal prism coupled thereto, and the polygonal prism of the insert member has a shape matched with an angular slot of the inner seat and an angular slot of the wedge, and an outer surface of the polygonal prism of the insert member has a ring groove formed at a position proximate to the top, and the polygonal prism of the insert member is provided for sheathing and installing an elastic member, and the ring groove is provided for clamping and positioning a latch ring; during assembling, the elastic member of the clutch lever is sheathed and mounted on the polygonal prism, and the polygonal prism is passed from bottom to top and out from the angular slot of the inner seat, such that the insert member of the clutch lever enters into the chamber of the inner seat; and then the control plate is installed next to the top side of the top side of the upper insert tube of the inner seat, and the round bump at the bottom of the control plate enters and stays in the upper sink socket at the top side of the upper insert tube, and the polygonal prism of the clutch lever is passed out from the penetrating hole of the control plate; and then the wedge is installed next to the top side of the control plate, such that the two through holes of the wedge are disposed across an elevating rib, and the polygonal prism of the clutch lever is passed from bottom to top and out from the angular slot of the wedge, and then the latch ring is clamped in the groove of the polygonal prism; and then the outer thread of the lower insert tube of the inner seat is screwed and engaged with the inner thread of the binding groove of the casing of the reducer to abut the O-ring at the junction of the lower insert tube and the baffle, while the periphery of the bottom of the baffle abuts the sink socket at the outer periphery of the top side of the binding groove for positioning; and then the socket portion of the operating handle is sheathed on the wedge and the clutch lever, and the wedge and the top end of the clutch lever enter into the first accommodation space of the socket portion, and the elevating rib of the control plate enter into the plurality of accommodating slots for positioning, and the plate body of the control plate and the socket of the inner seat enter into the second accommodation space, while the inner wall of the socket portion abuts the O-ring sheathed on the upper ring groove of the upper socket, and the screw hole of the socket portion is aligned precisely with the lower ring groove of the upper socket, and then the positioning bolt is screwed into each screw hole, so that the rear end of the positioning bolt passes out from the screw hole and enters into the lower ring groove.

2. The power winch horizontal-push winch according to claim 1, wherein the operating handle has a plurality of even accommodating slots grouped on the same straight line and provided for selecting an appropriate angular position suitable for accommodating the elevating rib.

3. The power winch horizontal-push winch according to claim 1, wherein the screw holes of the operating handle are formed on the transversally symmetric walls of the socket portion.

4. The power winch horizontal-push winch according to claim 1, wherein the operating handle has a penetrating hole formed at a position of the handle portion proximate to the outer side of the operating handle.

5. The power winch horizontal-push winch according to claim 4, wherein the penetrating hole of the handle portion is provided for installing an end hold of a rod-shaped object, and a force may be applied to operate the rod-shaped object to link and turn the handle portion to deflect transversely.

* * * * *